US006108019A

United States Patent [19]

Katsuma et al.

[11] Patent Number: 6,108,019

[45] Date of Patent: Aug. 22, 2000

[54] THERMAL PRINTING METHOD FOR PREVENTING DEGRADING OF PRINT QUALITY DUE TO FLUCTUATION IN TRANSPORT SPEED OF RECORDING SHEET

[75] Inventors: Nobuo Katsuma; Hisashi Enomoto, both of Saitama, Japan

[73] Assignee: Fuji Photo Film Co., Ltd., Kanagawa, Japan

[21] Appl. No.: 09/120,184

[22] Filed: Jul. 22, 1998

[30] Foreign Application Priority Data

Aug. 27, 1997 [JP] Japan ..... 9-230945

[51] Int. Cl.[7] ..... B41J 2/35; B41J 2/36; B41J 2/365

[52] U.S. Cl. ..... 347/188; 347/195

[58] Field of Search ..... 347/188, 218, 347/195, 196, 194; 400/120.09, 120.14, 120.15

[56] References Cited

U.S. PATENT DOCUMENTS 5,555,462 9/1996 Fukumoto et al. ..... 347/218

FOREIGN PATENT DOCUMENTS 2580597 11/1996 Japan ..... B41J 17/02
10-076697 3/1998 Japan .

*Primary Examiner*—Huan Tran
*Attorney, Agent, or Firm*—Sughrue, Mion, Zinn, Macpeak & Seas, PLLC

[57] ABSTRACT

A thermal printing method for printing an image line by line on a recording material by driving an array of heating elements of a thermal head while transporting the recording material relative to the thermal head. Heating data for recording a subject line to print is corrected in accordance with heat accumulation amounts of the heating elements. Surface temperatures of the respective heating elements are estimated on the basis of corrected heating data. A frictional force that will be generated between the thermal head and the recording sheet on recording the subject line is calculated on the basis of the estimated surface temperatures. The heating elements start being driven to record the subject line at a time shifted by a time shifting amount from a standard time. The time shifting amount is determined depending upon the frictional force so as to eliminate influence of fluctuations in transport speed of the recording sheet on the printed image.

9 Claims, 9 Drawing Sheets

THERMAL PRINTING METHOD FOR PREVENTING DEGRADING OF PRINT QUALITY DUE TO FLUCTUATION IN TRANSPORT SPEED OF RECORDING SHEET

BACKGROUND OF THE INVENTION

1. Field of the Invention

The present invention relates to a thermal printing method and a thermal printer w herein print quality may not be degraded by fluctuation in transport speed of a recording sheet through the thermal head that is resulted from variation in friction between the thermal head and the recording sheet.

2. Description of the Related Art

There are thermosensitive recording type thermal printers and thermal transfer type thermal printers. The former heats a thermosensitive recording sheet directly with a thermal head, to cause the sheet to develop color. The latter heats the back of an ink ribbon placed upon a recording sheet to transfer ink to the recording sheet. The thermal printer has a thermal head which has an array of heating elements arranged on a ceramic substrate. The array of heating elements correspond to a line of pixels, and the heating elements are each individually driven to record a dot at a time, so that an image is printed line by line on the recording sheet.

In the thermosensitive recording type and the sublimation ink transfer type thermal printing, one dot constitutes one pixel of the printed image, and has a variable density including a zero level, that is designated by input image data for each pixel. In case of color thermal printing using at least three primary colors, three color dots having variable densities constitute one pixel of a printed full-color image.

As the temperature of the individual heating element varies with the recording density, so do the friction factor between the thermal head and the recording sheet. That is, the friction factor or the coefficient of friction decreases as the heat energy of the heating element increases, and increases as the heat energy decreases. This is because the surface smoothness of the recording sheet increases with an increase of the surface temperature.

The variation in friction factor between the thermal head and the recording sheet results a variation in load applied to the mechanisms such as the transport mechanism of the recording sheet and the support mechanism of the thermal head. Since the mechanisms are slightly deformed by the applied load, the amount of deformation varies with the load. As a result, transport amount of the recording sheet per unit time, i.e., actual transport speed through the thermal head per one drive pulse of the paper transport mechanism, varies with the variation of the friction between the thermal head and the recording sheet.

The fluctuation in actual transport speed results a variation in length of one pixel or dot in the transport direction of the recording sheet. Where the density changes from a high value to a low value, the friction factor increases, and the actual transport speed decreases. With decreasing actual transport speed, the heat energy applied per unit area gets larger, so that the recording density gets higher than expected. Where the density changes from a low value to a high value, the friction factor decreases, and the actual transport speed increases, so that the recording density gets lower than expected.

Accordingly, where the density of the original steeply changes, the tone reproduction is lowered by the transport amount fluctuation. In addition, since the three primary color densities of the original vary differently from each other, the location where the density varies steeply are also different between the colors. Therefore, the frictional variation also results color failures.

In order to keep the print quality from lowering in spite of the transport amount fluctuation, JPA No. 63-296976 discloses a method wherein the actual transport speed is measured for use in correction. However, this method needs an accurate speed measurement device since the fluctuation in transport speed is very small.

SUMMARY OF THE INVENTION

A prime object of the present invention is, therefore, to provide a thermal printing method, and a thermal printer therefor, which minimizes unexpected variation in recording density at those portions where the density of the original steeply changes, in spite of fluctuation in transport amount of the recording sheet per unit time that is caused by variations in friction factor between the thermal head and the recording sheet resulted from temperature changes of the thermal head.

To achieve the above object in a thermal printing method for printing an image line by line on a recording material by driving an array of heating elements of a thermal head while transporting the recording material relative to the thermal head, the present invention provides the steps of:

- estimating surface temperatures of the respective heating elements on the basis of heating data applied to the thermal head for recording a subject line to print;
- obtaining data of friction between the thermal head and the recording sheet on recording the subject line on the basis of the estimated surface temperatures as a factor to cause a fluctuation in transport speed of the recording material through the thermal head;
- determining a time shifting amount with respect to a standard time to start recording the subject line depending upon the friction data; and
- starting driving the heating elements to record the subject line at a time shifted by the time shifting amount from the standard time, thereby to eliminate influence of fluctuations in transport speed of the recording sheet on the printed image.

On the other hand, most of heat energy generated from the heating elements is used for recording, but the rest stays unused or dissipates. The unused heat energy is mainly accumulated in a glazed layer which is formed between the heating elements and the ceramic substrate. Part of the accumulated heat energy is transmitted from the glazed layer to the ceramic substrate and is accumulated therein, or partly transmitted further to an aluminum plate supporting the substrate and is accumulated therein. From the aluminum plate, the heat energy is partly transmitted to a radiation plate, and radiates from the radiation plate. Hereinafter, the layers disposed under the heating elements will be referred to as heat accumulating layers.

The amount of accumulated heat energy depends on the past heating states or thermal history of the heating elements. In addition to the heat energy accumulated in each heating element, part of heat energy accumulated in adjacent heating elements may be transmitted and have influence on the thermal history of each heating element. Part of the heat energy accumulated in the heating element is added to the heat energy that is newly generated from the heating element for the next pixel.

Accordingly, it is preferable to consider the influence of heat accumulation on the heat energy generated from the heating element when estimating the surface temperatures of the heating elements.

According to a preferred embodiment, the thermal printing method of the present invention further comprises the steps of:

calculating a heat accumulation amount for each of the heating elements of the thermal head on the basis of heating data applied to the thermal head for recording preceding lines;

correcting original heating data for the subject line in accordance with the heat accumulation amounts of the respective heating elements; and driving the heating elements in accordance with corrected heating data, wherein surface temperatures of the heating elements are estimated on the basis of the corrected heating data.

BRIEF DESCRIPTION OF THE DRAWINGS

The above and other objects and advantages of the present invention will become apparent from the following detailed description of the preferred embodiments when read in connection with the accompanying drawings, which are given by way of illustration only and thus are not limitative of the present invention, wherein like reference numerals designate like or corresponding parts throughout the several views, and wherein.

DETAILED DESCRIPTION OF THE PREFERRED EMBODIMENT

Figure 1:
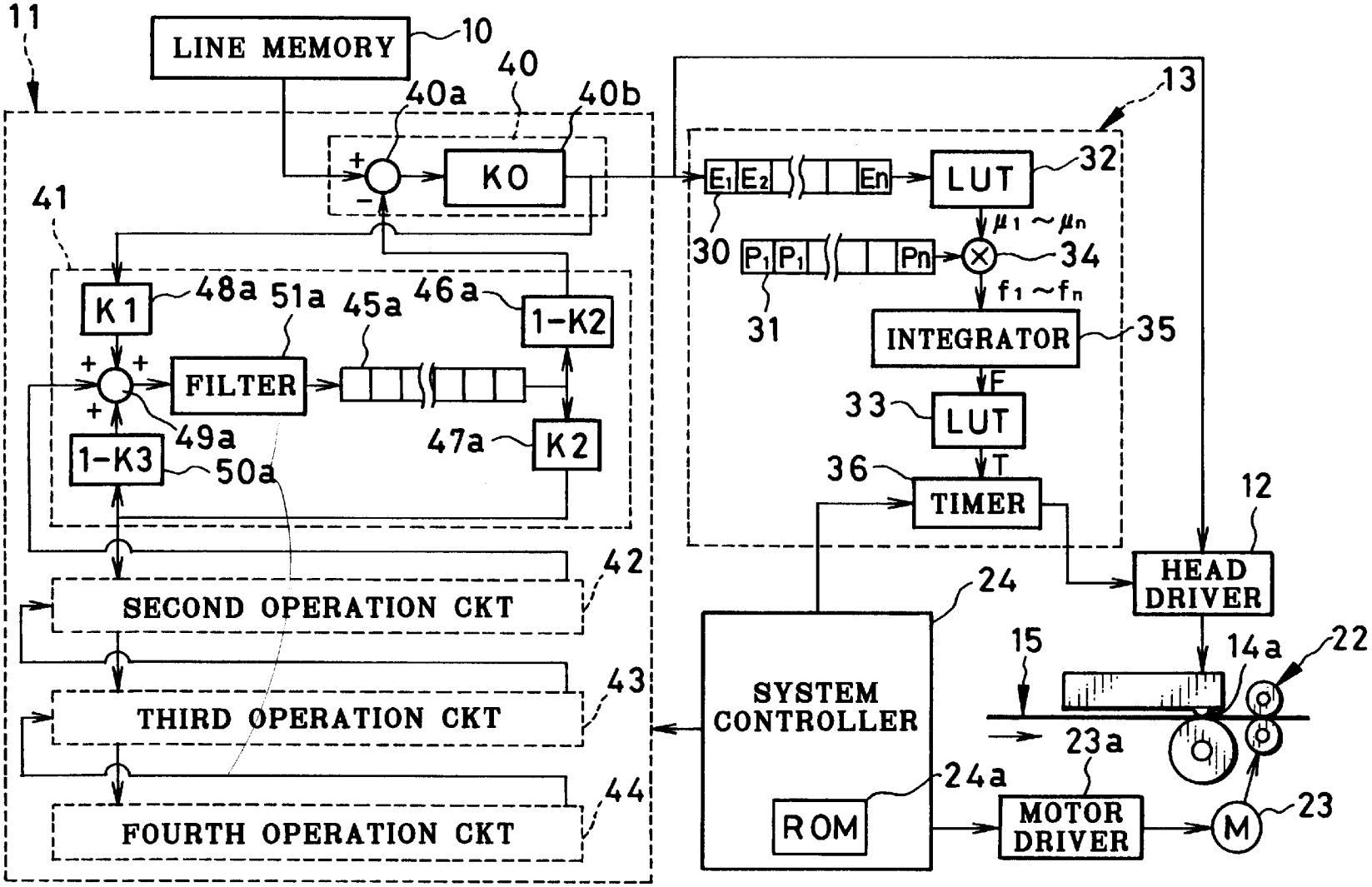
FIG. 1 is a schematic diagram of a thermal printer according to a first embodiment of the present invention.

FIG. 1 shows essential parts of a thermosensitive recording type thermal printer embodying the present invention. Original heating data of one line written in a line memory 10 is sent to a data processing circuit 11 for correcting the original heating data so as to prevent the heat accumulation from affecting density of an image to print. The corrected heating data of one line is sent to a head driver 12 and a heating start timing correction circuit 13.

Figure 2A:
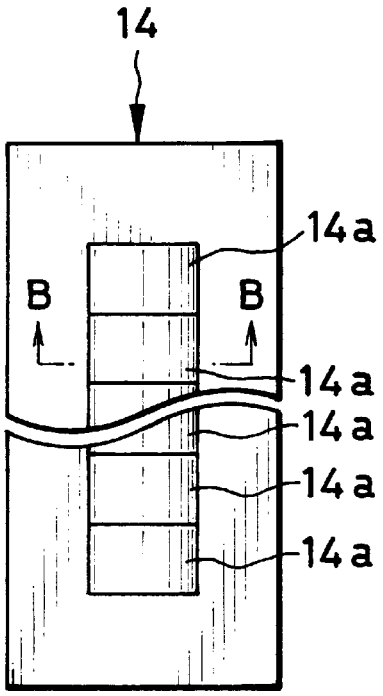
FIG. 2A is an explanatory plan view of a thermal head.
Figure 2B:
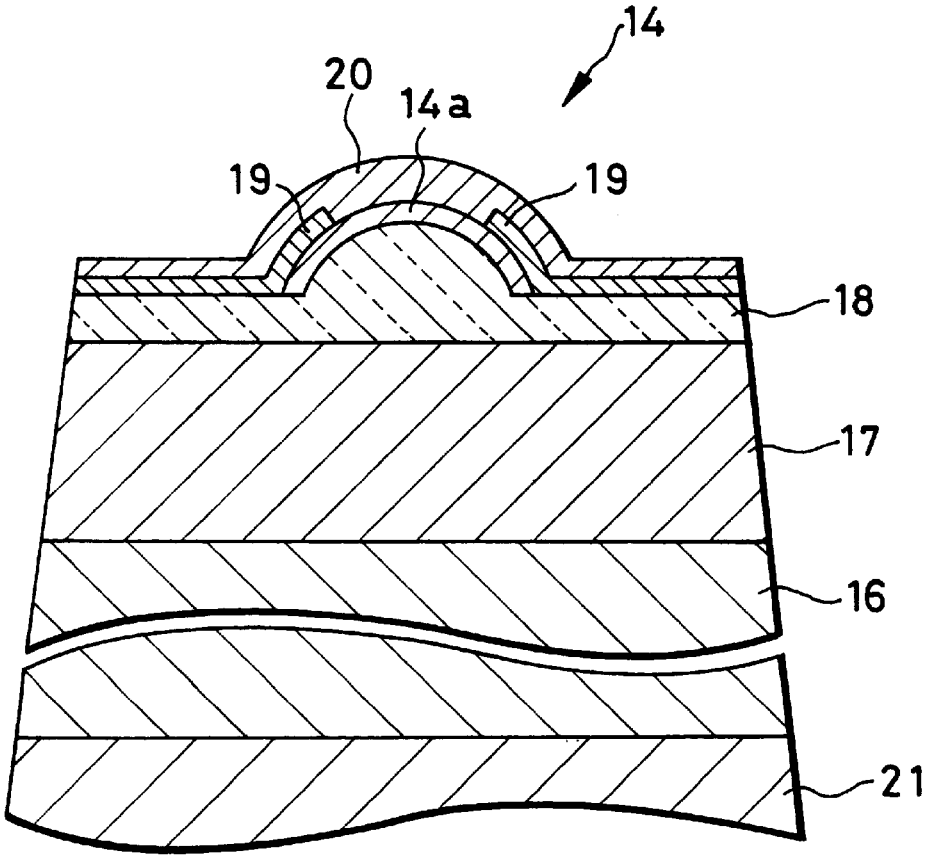
FIG. 2B is an explanatory sectional view of the thermal head illustrating layered structure thereof.

The head driver 12 drives a thermal head 14 while the thermal head 14 is in tight contact with a thermosensitive recording sheet 15. As shown in FIG. 2A, the thermal head 14 has a number of heating elements 14*a* aligned in a main scan direction perpendicular to a transport direction of the recording sheet 15. As shown in FIG. 2B, each heating element 14*a* is a resistance heating film which is connected to a pair of electrodes 19. The heating elements 14*a* and the electrodes are disposed on a glazed layer 18 that is formed on one surface of a ceramic substrate 17. The substrate 17 is fixedly mounted on an aluminum plate 16, and a radiation plate 21 is fixedly mounted on the opposite side of the aluminum plate 16. The heating elements 14*a* and the electrodes 19 are covered with a protection layer 20. The glazed layer 18, the ceramic substrate 17, the aluminum plate 16 and the radiation plate 21 constitute heat accumulating layers which accumulate a fraction of heat energy generated from the heating elements 14*a*. Because the accumulated heat energy have influence on density of an image to print, the data processing circuit 11 corrects the original heating data so as to eliminate the influence of the heat accumulation.

In correspondence with the heating data of one pixel, an amount of electric power is supplied to one heating element 14*a,* so the heating element 14*a* generates heat energy whose value corresponds to the heating data. The amount of electric power is changed by adjusting time duration of continuous power supply, or by adjusting the number of times of periodic power supply.

The thermosensitive recording performs bias heating and image or gradation heating to record a dot. The bias heating is to heat the thermosensitive recording sheet 15 up to a degree slightly less than a coloring point of the recording sheet 15 at which color begins to develop. The gradation heating is to heat the thermosensitive recording sheet 15 by a degree that corresponds to a designated coloring density. For the bias heating, all heating elements 14*a* are uniformly heated by bias data. The bias data is basically the same for all heating elements. However, if there is any variance between resistance values of the heating elements 14*a,* the bias data is adjusted to compensate for the variance. The gradation heating is performed in accordance with input image data. Therefore, in the thermosensitive recording, the heating data consists of the bias data and the image data. Since the thermal transfer recording performs only the gradation heating, the heating data corresponds to the image data. In the thermosensitive recording, the image data or the bias data or both may be processed in the data processing circuit 11.

The heating start timing correction circuit 13 determines on the basis of the corrected heating data a shifting amount for a standard timing signal that is generated synchronously with the transport of the recording sheet 15, and is used for determining a time to start driving the heating elements 14*a* for each line recording. The heating start timing correction circuit 13 sends a shifted timing signal to the head driver 12.

The head driver 12 drives the thermal head 14 in accordance with the corrected heating data at intervals determined by the timing signal from the heating start timing correction circuit 13.

The recording sheet 15 is transported by feed rollers 22 synchronously with the driving intervals of the thermal head 14. The feed rollers 22 are driven by a pulse motor 23 that is controlled by a system controller 24 through a motor driver 23*a*. The system controller 24 sends not only the standard timing signal but also drive pulses to the motor driver 23 for rotating the pulse motor 23. In this way, the heating elements 14*a* are driven synchronously with the transport of the recording sheet 15, so an image is recorded line by line on the recording sheet 15.

As shown in FIG. 1, the heating start timing correction circuit 13 is constituted of a heat energy data register 30, a pressure data register 31, first and second look up table memories (LUTs) 32 and 33, a multiplier 34, a integrator 35 and a timer 36. In the heat energy data register 30 is written a series of corrected heating data from the data processing circuit 11 at each line recording. The corrected heating data is serially sent from the heat energy data register 30 to the first LUT 32, and is used as heat energy data $E_1$to $E_n$ of the respective heating elements 14*a* for each line recording.

Figure 3:
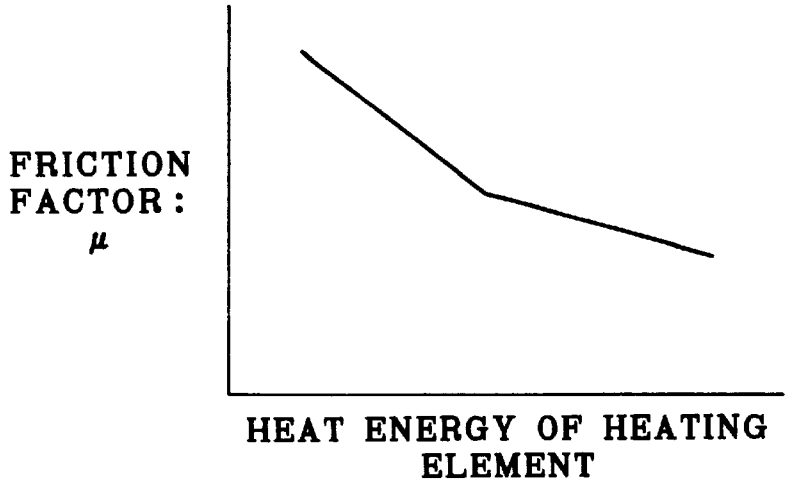
FIG. 3 is a graph showing a relationship between heat energy of heating elements and coefficient of friction of the thermal head against a recording sheet.

The first LUT 32 stores table data showing a relationship between the heat energy data $E_1$ to $E_n$ and friction factor $\mu$ between the thermal head 14 and the recording sheet 15. As shown in FIG. 3, the friction factor $\mu$ declines as the heat energy of the heating element 14*a* arises. Different table data is previously obtained by experiments or the like for different types of recording media which are to be used as the recording sheet 15, and stored in a ROM 24*a* of the system controller 24. One of the previously obtained table data is written in the first LUT 32 in accordance with the type of the used recording sheet 15. Thus, the first LUT 32 sends the multiplier 34 a series of friction factor data $\mu_1$ to $\mu_n$ in correspondence with the heat energy data $E_1$ to $E_n$ from the heat energy data register 30.

Figure 4:
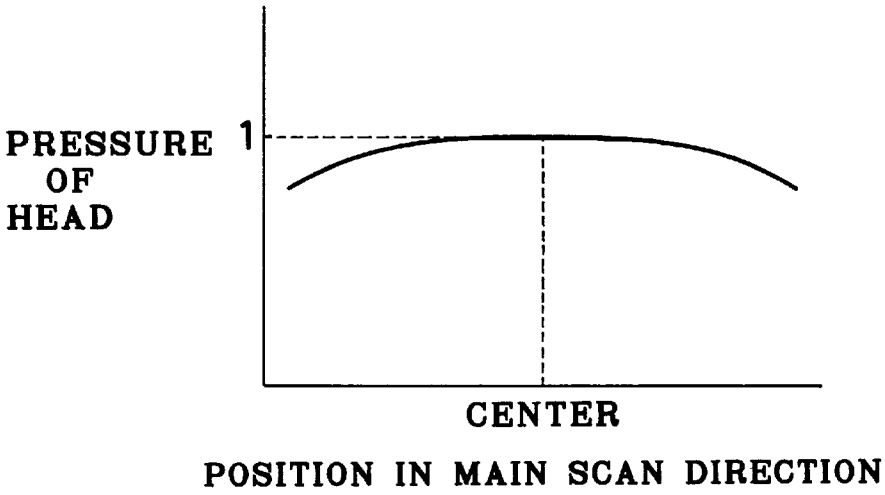
FIG. 4 is a graph showing a pressure distribution curve of the thermal head onto the recording sheet.

The pressure data register 31 stores pressure data $P_1$, to $P_n$ representative of a pressure value applied from each individual heating element 14*a* to the recording sheet 15 during the recording. The pressure values of the respective heating elements 14*a* are measured for each thermal printer at a final adjustment process in the factory, and are written as pressure data in the ROM 24*a* before the shipment. In place of the ROM 24*a,* it is possible to use a non-volatile RAM. FIG. 4 shows an example of distribution curve of the pressure values of the heating elements 14*a*. It is alternatively possible to detect average pressure values of the respective heating elements for each type of thermal printer, and substitute the average pressure values for the measured pressure values. According to the present embodiment, a pressure value of the center heating element in the main scan direction is regarded as a reference value "1", so pressure values of other heating elements of the thermal head 14 are represented as relative values to the reference value. The pressure data $P_1$ to $P_n$ of the respective heating elements 14*a* are sent to the multiplier 34 serially and synchronously with the friction factor data $\mu_1$ to $\mu_n$ being sent from the first LUT 32 to the multiplier 34.

The multiplier 34 multiplies the friction factor data $\mu$hd 1to $\mu_n$ with the pressure data $P_1$ to $P_n$ by each individual heating element 14*a,* to produce frictional force data $f_1$ to $f_n$ for the respective heating elements 14*a*. The frictional force data $f_1$ to $f_n$ is sent to the integrator 35. The integrator 35 integrates the frictional force data $f_1$ to $f_n$ to obtain a total frictional force F of the thermal head 14 at each line recording. Data of the total frictional force F is sent to the second LUT 33.

Figure 5:
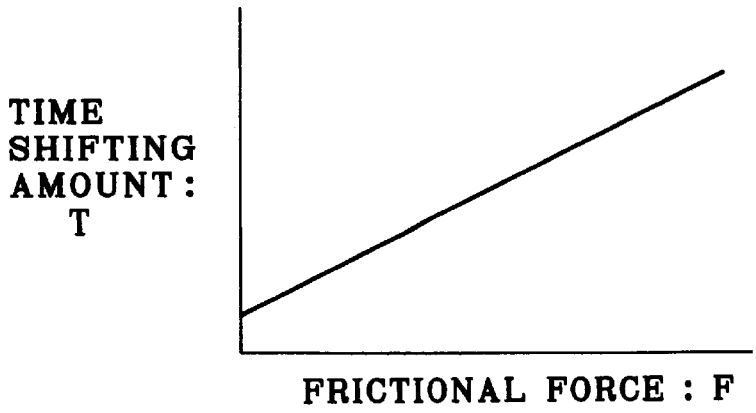
FIG. 5 is graph showing a relationship between frictional force and shifting amount of heating start timing for one line.

The second LUT 33 stores table data showing a relationship between the total frictional force F of the thermal head 14 and time shifting amount T relative to the standard timing signal. As shown in FIG. 5, the time shifting amount T increases with an increase of the frictional force F. Different table data is predetermined for different types of recording media which are to be used as the recording sheet 15, and stored in the ROM 24*a* of the system controller 24. One of the predetermined table data is written in the second LUT 33 in accordance with the type of the used recording sheet 15. The second LUT 33 derives a time shifting amount T from the total frictional force F at each line recording, and sends the amount T to a timer 36.

Figure 6:
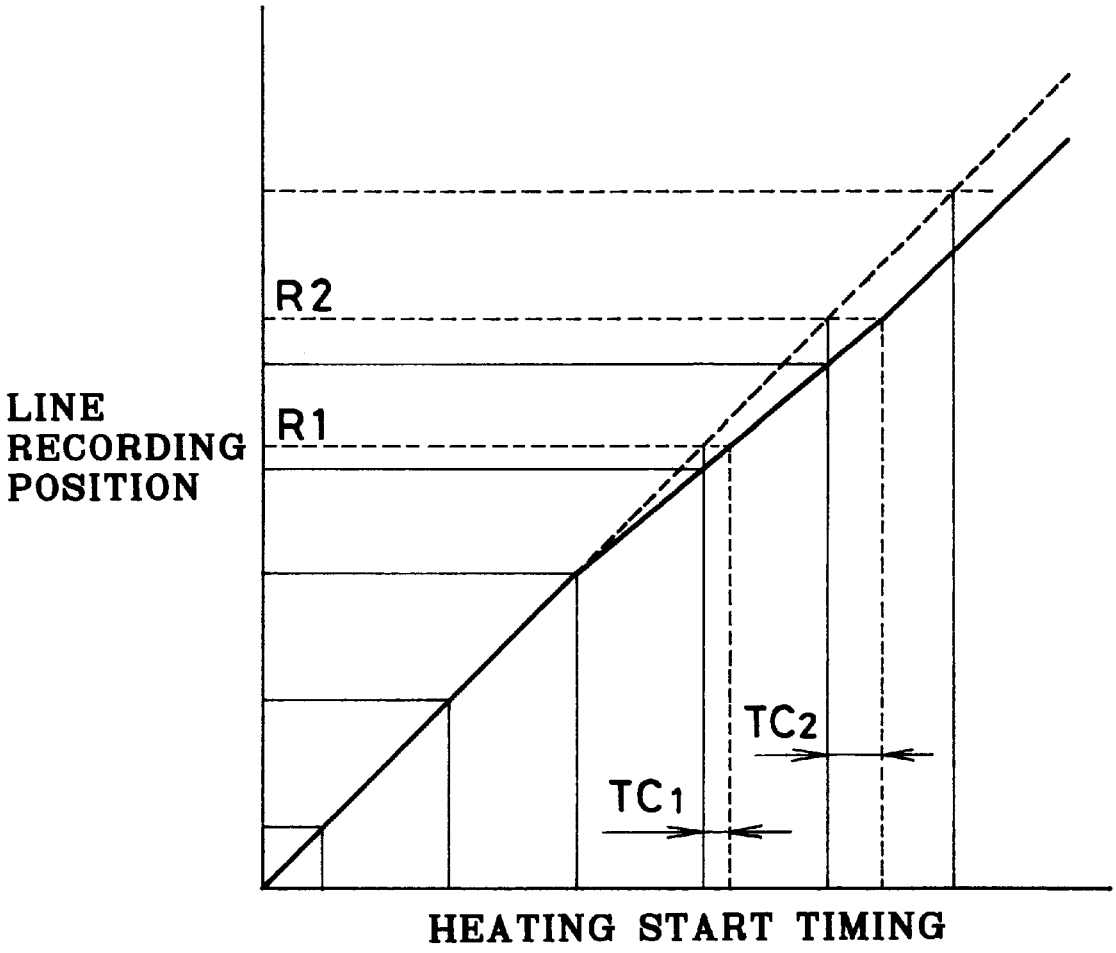
FIG. 6 is a graph showing a relationship between the heating start timing and line recording position.

The timer 36 shifts the standard timing signal from the system controller 24 in accordance with the time shifting amount T, and the shifted signal is sent to the head driver 12. Accordingly, even through the actual transport speed fluctuates according to the variation in the friction factor between the thermal head 14 and the recording sheet 15, since the phase of the timing signal is shifted from its standard positions shown by solid lines in FIG. 6 by different amounts TC1 and TC2 so as to correct dot recording positions depending upon variations in the frictional force F, dots of each line start being recorded at proper positions R1 and R2 as shown by dashed lines in FIG. 6. In FIG. 6, dot recording positions shown by solid lines indicate those positions where the dots of each line would be recorded without any correction of the heating start timing. In this way, color failures and unexpected density variation are minimized.

Figure 11:
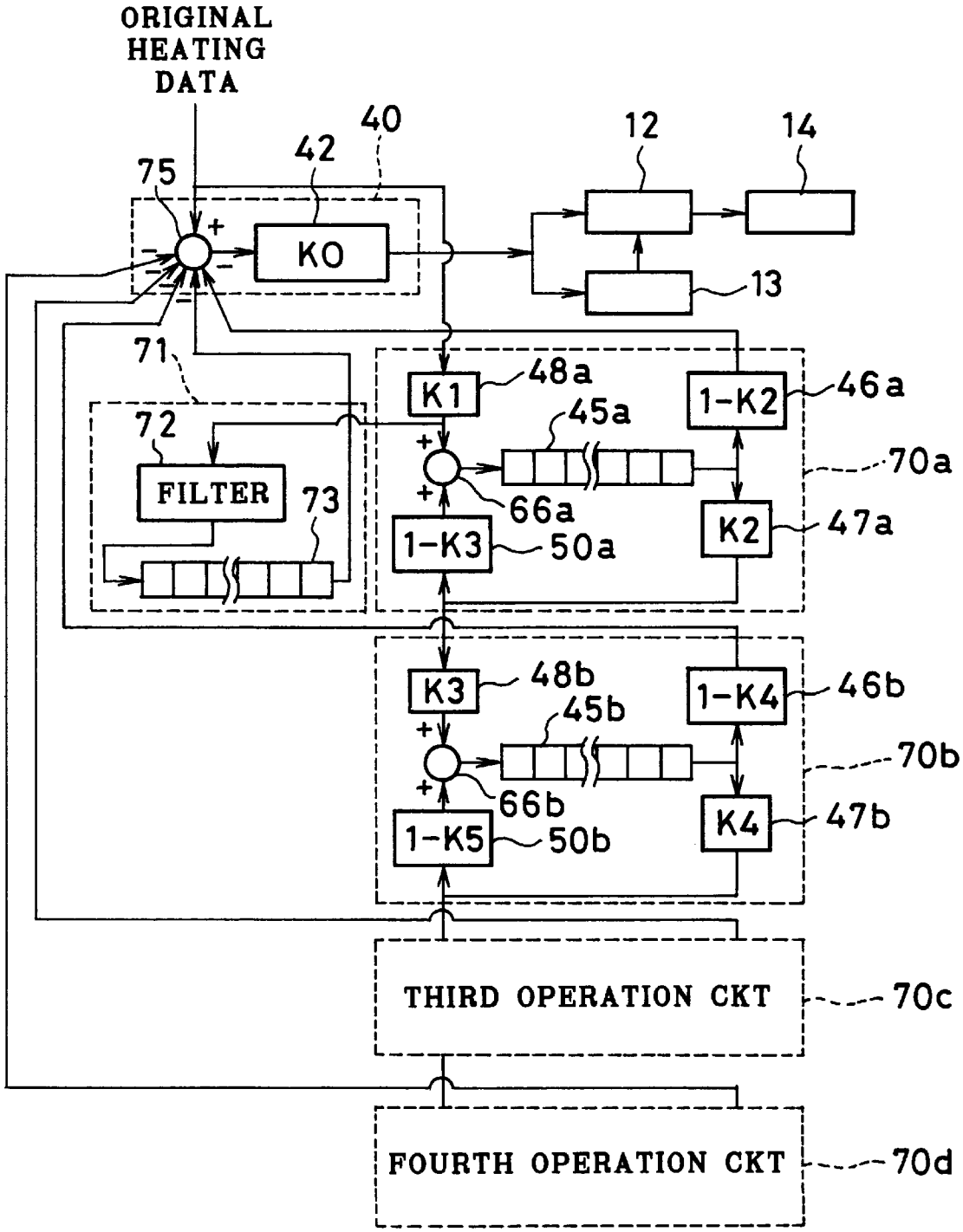
FIG. 11 is a block diagram showing a data processing circuit according to a fourth embodiment of the present invention.

FIG. 11 shows an embodiment of the data processing circuit 11. The data processing circuit 11 is constituted of a correction circuit 40 and first to fourth operation circuits 43*a,* 43*b,* 43*c* and 43*d*. The first to fourth operation circuits 43*a* to 43*d* are provided for calculating correction data for correcting original heating data with regard to heat accumulation in the glazed layer 18, the substrate 17, the aluminum plate 16 and the radiation plate 21 respectively. Hereinafter, the correction data obtained from the first to fourth operation circuits 43*a* to 43*d* will be referred to as first to fourth correction data respectively.

The correction circuit 40 includes a subtracter 41 for subtracting the first correction data from the original heating data, and a multiplier 42 for multiplying the heating data after the subtraction by a coefficient "K0", e.g. K0=1/(1−K1). Although heat energy generated from the individual heating element 14*a* is mostly transmitted or transferred to the recording sheet 15, a small fraction of the heat energy is transmitted to the glazed layer 18. The coefficient "K0" is designed to compensate for the fraction of the heat energy that is transmitted not to the recording sheet 15, but to the glazed layer 18.

The first correction data from the first operation circuit 43*a* is to correct the original heating data with regard to the influence of heat energy accumulated in the glazed layer 18 on the individual heating elements 14*a*. When recording an initial line or the first line in the order of recording an image, the original heating data of the first line is sent in serial from the line memory 10 to the subtracter 41. Since heat accumulation in the glazed layer 18 is ideally zero at the start of recording the first line, the first correction data is zero. Thus, the original heating data is multiplied by the coefficient "K0" to produce corrected heating data. The corrected heating data is sent from the correction circuit 40 to the head driver 12 and to the first operation circuit 43*a*. Based on the corrected heating data of one line and other data relating to heat accumulation in the glazed layer 18, the first operation circuit 43*a* calculates the first correction data for the next line.

Specifically, the first operation circuit 43*a* has a register 45*a* which stores first heat accumulation data that represents the thermal history of the glazed layer 18, i.e. condition of heat energy accumulated in the glazed layer 18 before the start of recording a line, hereinafter called line #M, i.e. by the end of recording the preceding line #M−1. The register 45*a* is a shift register having memory cells corresponding in number and arrangement to the heating elements 14*a* of the thermal head 14, and thus to pixels constituting one line. The first heat accumulation data for one pixel or relating to one heating element 14*a,* as written in each memory cell of the register 45*a,* represents a heat accumulation in the glazed layer 18 that has effect on the corresponding heating element 14*a.*

The first heat accumulation data for one line stored in the register 45*a* is sent in serial to multipliers 46*a* and 47*a*. The multiplier 46*a* seriatim multiplies the first heat accumulation data by a coefficient "1−K2", to provide the first correction data. The coefficient "1−K2" corresponds to a fraction of the accumulated heat energy that is transmitted from the glazed layer 18 to the heating elements 14*a*. Accordingly, the first correction data for one pixel represents a heat energy value that is transmitted from the glazed layer 18 to the corresponding heating element 14*a,* and is added to the heat energy newly generated from the corresponding heating element 14*a*. The first correction data is sent in serial to the subtracter 41 of the correction circuit 40.

To the subtracter 41, original heating data of the line #M is sent in serial from the line memory 10 in the same sequence and at the same timing as the first correction data. Thus, the first correction data for one pixel is subtracted from the original heating data for the corresponding pixel. Thereafter, the heating data after the subtraction is multiplied by the coefficient "K0". The corrected heating data of the line #M is sent to the head driver 12, and also to a multiplier 48*a*. The multiplier 48*a* multiplies the corrected heating data by a coefficient K1. The coefficient K1 corresponds to the fraction of heat energy that is transmitted from the heating elements 14*a* to the glazed layer 18*a*. Accordingly, the output data of the multiplier 48*a* obtained for each pixel from the corrected heating data of the line #M represents a heat energy value that is transmitted from the corresponding heating element 14*a* to the glazed layer 18, and is newly accumulated therein at the end of recording the line #M. The output data of the multiplier 48*a* is sent in serial to an adder 49*a*.

The other multiplier 47*a* multiplies the first heat accumulation data by a coefficient "K2" to convert it into data representative of a fraction of heat energy that has been accumulated in the glazed layer 18 due to the past heating and is not transmitted to the heating elements 14*a*. The output data of the multiplier 47*a* is sent to a multiplier 50*a* and the second operation circuit 43*b*. The multiplier 50*a* multiplies the output data of the multiplier 47*a* by a coefficient "1−K3" to convert it into data representative of a fraction of heat energy that stays accumulated in the glazed layer 18. In other words, a coefficient "K3" corresponds a fraction of heat energy that is transmitted from the glaze layer 18 further to the substrate 17. Therefore, the output data of the multiplier 50*a* thus obtained for each pixel from the first heat accumulation data represents a heat energy value that has been accumulated due to the past heating of the corresponding heating element 14*a* and stays accumulated to the end of recording the line #M in an individual portion of the glazed layer 18 that is disposed under the corresponding heating element 14*a*. The output data of the multiplier 50*a* is sent in serial to the adder 49*a* in the same sequence as the output data of the multiplier 48*a*.

At the adder 49*a,* the output data of the multiplier 48*a* for one pixel, and the output data of the multiplier 50*a* for the corresponding pixel, and also the second correction data for the corresponding pixel are added. The second correction data is sent from the second operation circuit 43*b* and represents for each pixel a heat energy value that is transmitted from the substrate 17 to the individual portion of the glazed layer 18 under the corresponding heating element 14*a*. The sum thus obtained for each pixel at the adder 49*a* is sent to a filter 51*a*. Hereinafter the sum obtained for each pixel at the adder 49*a* will be called an individual heat accumulation value, which represents a heat energy value accumulated in the individual portion of the glazed layer 18 at the end of recording the line #M. The filter 51*a* processes the individual heat accumulation value through a filtering operation as set forth in detail below, to convert each individual heat accumulation value into an effective heat accumulation value for each pixel, taking the effect of heat accumulation in the adjacent portions as well as in the individual portion of the glazed layer 18 into consideration. The effective heat accumulation values obtained by the filter 51*a* are sent in serial to the register 45*a,* and are sequentially overwritten therein as a new series of first heat accumulation data.

In recording the next line #M+1, the first heat accumulation data stored in the register 45*a* in the end of recording the line #M is sent in serial to the multipliers 46*a* and 47*a*. The multiplier 46*a* seriatim multiplies the first heat accumulation data by the coefficient "1−K2", to provide the first correction data for the line #M+1. The first correction data is sent in serial to the subtracter 41 of the correction circuit 40. To the subtracter 41, original heating data of the line #M+1 is sent in serial from the line memory 10 in the same sequence and at the same timing as the first correction data. Thus, the first correction data for one pixel of the line #M+1 is subtracted from the original heating data for the corresponding pixel of the line #M+1.

Thereafter, the heating data after the subtraction is multiplied by the coefficient "K0". The corrected heating data of the line #M+1 is sent to the head driver 12, and also to the multiplier 48*a*. In the same way as above, the first heat accumulation data in the register 45*a* is revised in the end of recording the line #M+1.

Figure 8:
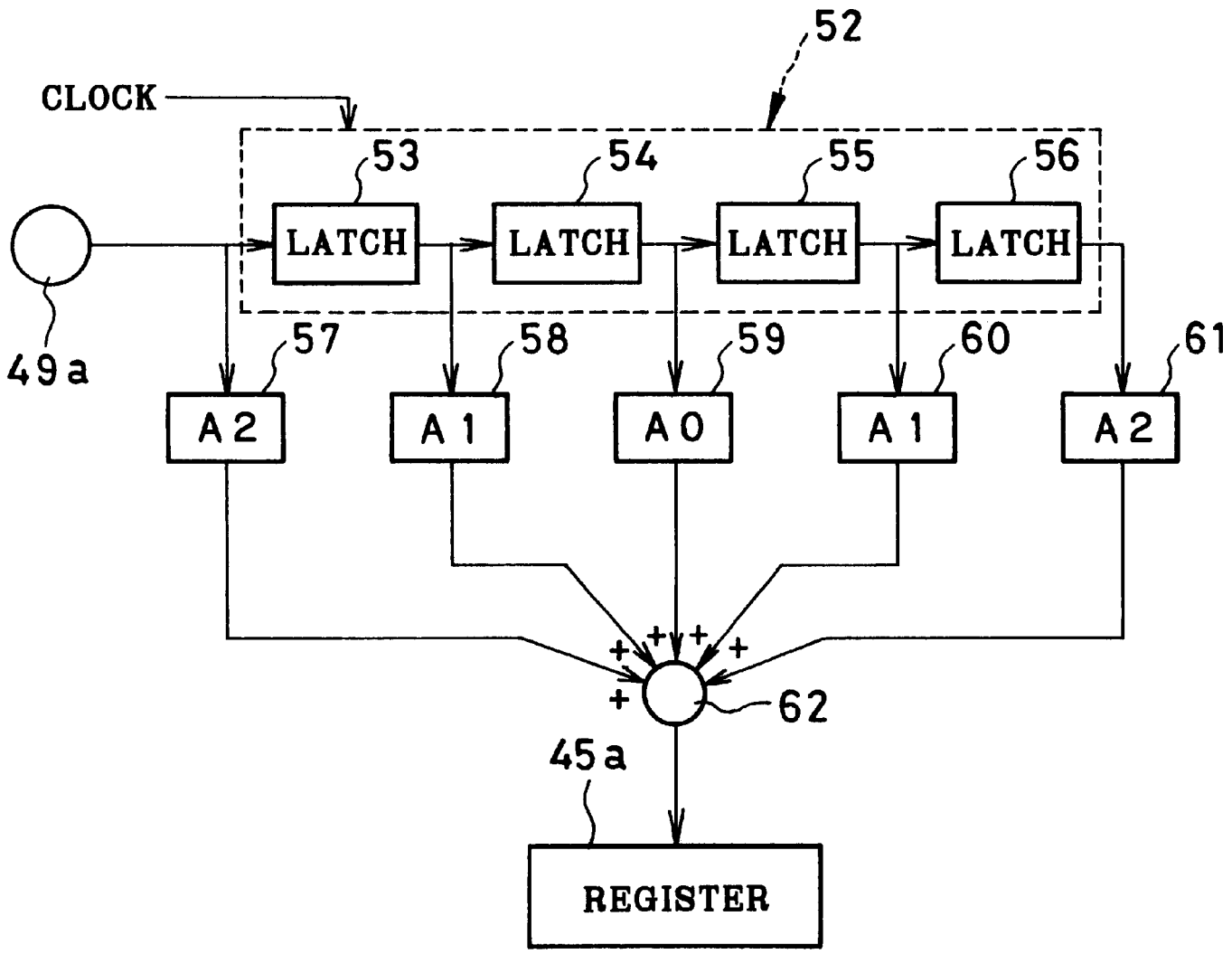
FIG. 8 is a block diagram showing a filter included in the data processing circuit.

FIG. 8 shows an example of the filter 51*a*. The filter 51*a* has a shift register 52 which is constituted of four cascade-connected latch circuits 53,54, 55 and 56. The output data of the adder 49*a* or individual heat accumulation values obtained during the recording of the line #M are sent in serial to the shift register 52, and shifted to the next latch circuit in response to a clock. The input and output terminals of the latch circuit 53 are connected to multipliers 57 and 58 respectively. The input and output terminals of the latch circuit 56 are connected to multipliers 60 and 61. The output terminal of the latch circuit 54 is connected to a multiplier 59.

The multipliers 57 and 61 multiply the individual heat accumulation values received therein by a coefficient "A2". The multipliers 58 and 60 multiply the individual heat accumulation values respectively received therein by a coefficient "A1". The multiplier 59 multiplies the individual heat accumulation value received therein by a coefficient "A0". The products, i.e. multiplication results from these multipliers 57 to 61 are added at an adder 62. The sum obtained at the adder 62 is sent to the register 62, to be written as first heat accumulation data for a subject pixel. In this case, the subject pixel is a pixel that is assigned to the individual heat accumulation value latched by the latch circuit 54.

As described above, the first heat accumulation data for one line and the heating data of one line are read respectively from the register 45*a* and the line memory 10 in the same sequence, that is, in order from one end to the other end of each line. Accordingly, an individual heat accumulation value for a first pixel that is disposed at the first position of the line in this order, is first sent from the adder 49*a* to the shift register 52, and is latched by the latch circuit 53 in response to a clock. Next, an individual heat accumulation value for a second pixel disposed at the second position of the line in the order, is sent to the shift register 52. In response to a second clock, the individual heat accumulation value for the first pixel is shifted to and latched by the latch circuit 54, and the individual heat accumulation value for the second pixel is latched by the latch circuit 53.

The filtering process starts when the shift register 52 latches the individual heat accumulation values for the first and second pixels and receives an individual heat accumulation value for a third pixel that is disposed at the third position of the line. The individual heat accumulation value for the first pixel is multiplied by the coefficient "A0" at the multiplier 59 and then sent to the adder 62. The individual heat accumulation value for the second pixel is multiplied by the coefficient "A1" at the multiplier 58 and then sent to the adder 62. The individual heat accumulation value for the third pixel is multiplied by the coefficient "A2" at the multiplier 57 and then sent to the adder 62. The sum obtained at the adder 62 constitutes an effective heat accumulation value in the glazed layer 16 relating to the first pixel, and is sent to the register 45*a,* to be written as the first heat accumulation data for the first pixel.

In this way, the individual heat accumulation value for the first pixel is not directly used as the first heat accumulation data for the first pixel, but the individual heat accumulation values for the two adjacent pixels are added to the individual heat accumulation value for the first pixel after these values are respectively multiplied by the coefficients A0, A1 and A2, which are predetermined according to the relative position to the subject pixel, i.e. the first pixel in this instance. Consequently, in addition to the individual heat accumulation value in a portion of the glazed layer 18 under a first heating element assigned to the first pixel, the individual heat accumulation values in those portions of the glazed layer 18 under second and third heating elements assigned to the second and third pixels are taken into consideration for correction the heating data for the first pixel. It is to be noted that the sum A0+A1+A2 of the coefficients A0, A1 and A2 is determined to be "1" in decimal notion.

When an individual heat accumulation value for a fourth pixel is received by the shift register 52, the individual heat accumulation values for the first to third pixels are latched in the latch circuits 55, 54 and 53 respectively. Then, the individual heat accumulation value for the second pixel is multiplied by the coefficient A0 at the multiplier 59, the individual heat accumulation value for the third pixel is multiplied by the coefficient A1 at the multiplier 58, and the individual heat accumulation value for the fourth pixel is multiplied by the coefficient A2 at the multiplier 57. Also, the individual heat accumulation value for the first pixel is multiplied by the coefficient A1 at the multiplier 60.

The four products from the multipliers 57 to 60 are added at the adder 62, to provide an effective heat accumulation value in the glazed layer 18 relating to the second pixel. Accordingly, the individual heat accumulation value for the second pixel is processed by use of the individual heat accumulation values for the adjacent first, third and fourth pixels.

When an individual heat accumulation value for a fifth pixel is received by the shift register 52, the individual heat accumulation values for the first to fourth pixels are latched in the latch circuits 56, 55, 54 and 53 respectively. Then, the individual heat accumulation value for the third pixel is multiplied by the coefficient A0 at the multiplier 59, the individual heat accumulation values for the first and fifth pixels are multiplied by the coefficient A2 at the multiplier 61 and 57 respectively, and the individual heat accumulation values for the second and fourth pixels are multiplied by the coefficient A1 at the multipliers 60 and 58 respectively.

The five products from the multipliers 57 to 61 are added at the adder 62, to provide an effective heat accumulation value in the glazed layer 18 relating to the third pixel. Accordingly, the individual heat accumulation value for the second pixel is processed by use of the individual heat accumulation values for the adjacent four pixels, two of which are disposed on either side of the third pixel in the same line.

In the same way as for the third pixel, the individual heat accumulation value for the fourth and those for the following pixels are each individually processed or converted into an effective heating accumulation value by use of individual heat accumulation values for the adjacent four pixels, two of which are disposed on either side of the subject pixel in the same line. When an individual heat accumulation value for a last pixel in the order of data reading is latched by the latch circuit 54, and is converted into an effective heat accumulation value for the last pixel through the filtering, a new series of first heat accumulation data, i.e. the first heat accumulation data obtained during the recording of the line #M in this instance, has been written in the register 45*a*.

In practice, two pieces of dummy data having a value "0" in decimal notion are added to either end of a series of heating data of each line. Because the dummy data is also processed in the same way as the heating data, the filtering operation is performed for any subject pixel by use of five individual heat accumulation values including that for the subject pixel, even for the first two pixels and the last two pixels of one line in the order of serial reading of the heating data. Needless to say, the dummy data has no effect on the actual printing.

Figure 7:
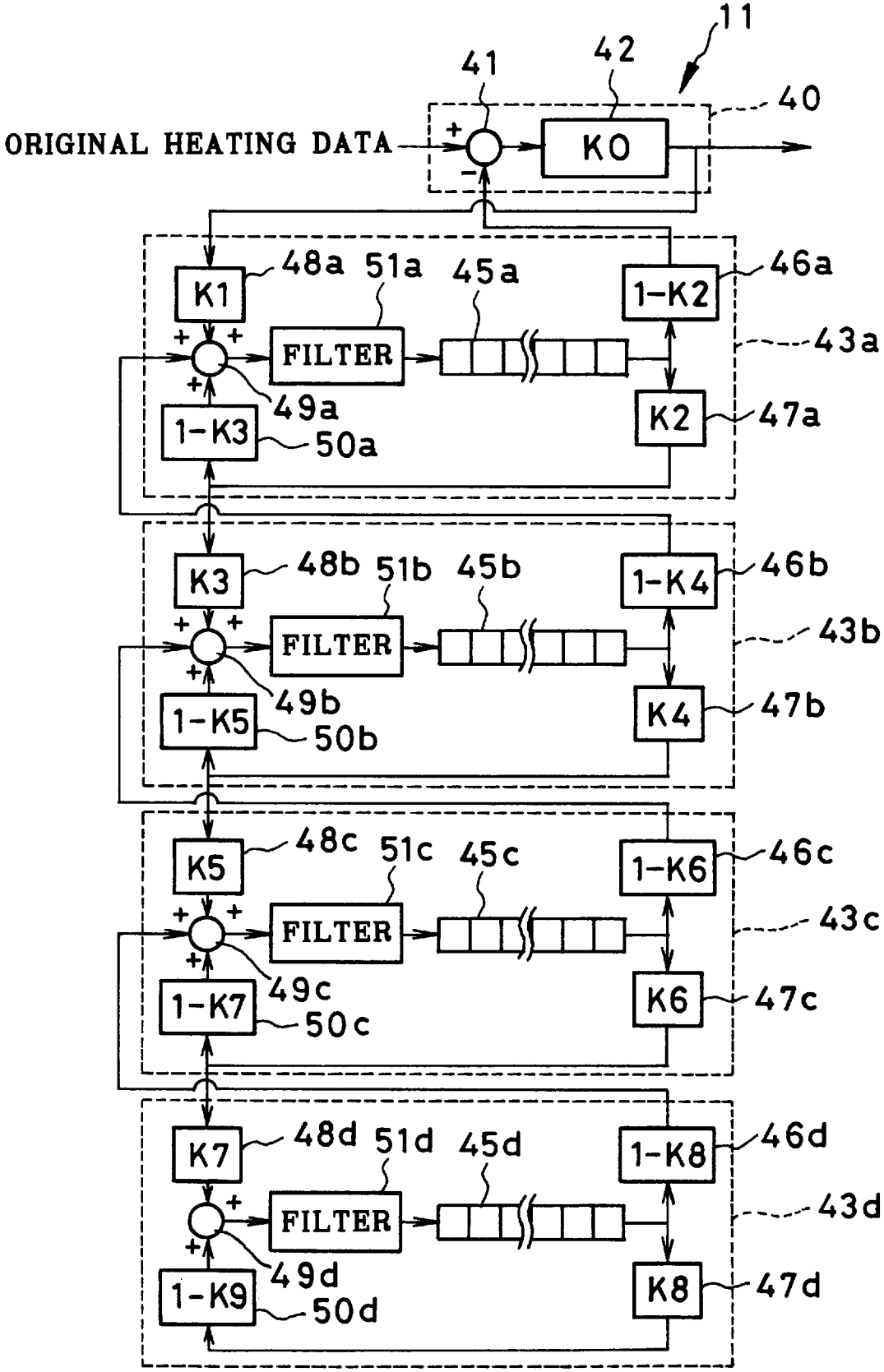
FIG. 7 is a block diagram showing the data processing circuit for correcting heating data according to the first embodiment.

As shown in FIG. 7, the second to fourth operation circuits 43*b* to 43*d* have the same construction as the first operation circuit 43*a*. The second operation circuit 43*b* is constituted of a register 45*b,* multipliers 46*b,* 47*b* and 48*b* and 50*b,* an adder 49*b,* and a filter 51*b*. The third operation circuit 43*c* is constituted of a register 45*c,* multipliers 46*c,* 47*c* and 48*c* and 50*c,* an adder 49*c,* and a filter 51*c*. The fourth operation circuit 43*d* is constituted of a register 45*d,* multipliers 46*d,* 47*d* and 48*d* and 50*d,*an adder 49*d,* and a filter 51*d*.

The second operation circuit 43*b* calculates the second correction data based on second heat accumulation data stored in the register 45*b,* that represents the thermal history of the substrate 17. The register 45*b* has memory cells corresponding in number and arrangement to the heating elements 14*a*. The second heat accumulation data written in each memory cell of the register 45*b* represents an effective heat accumulation value in the substrate 17 that has effect on the corresponding heating element 14*a*.

The third operation circuit 43*c* calculates the third correction data based on third heat accumulation data stored in the register 45*c,* that represents the thermal history of the aluminum plate 16. The register 45*c* has memory cells corresponding in number and arrangement the heating elements 14*a*. The third heat accumulation data written in each memory cell of the register 45*c* represents an effective heat accumulation value in the aluminum plate 16 that has effect on the corresponding heating element 14*a*.

The fourth operation circuit 43*d* calculates the fourth correction data based on fourth heat accumulation data stored in the register 45*d*, that represents the thermal history of the radiation plate 21. The register 45*d* has memory cells corresponding in number and sequence to the array of heating elements 14*a*. The fourth heat accumulation data written in each memory cell of the register 45*d* represents an effective heat accumulation value in the radiation plate 21 that has effect on the corresponding heating element 14*a*.

The multipliers 46*b* to 48*b* and 50*b* of the second operation circuit 43*b* are allotted coefficients "1−K4", "K4", "K3" and "1−K5" respectively. The multipliers 46*c* to 48*c* and 50*c* of the third operation circuit 43*c* are allotted coefficients "1−K6", "K6", "K5" and "1−K7"respectively. The multipliers 46*d* to 48*d* and 50*d* of the fourth operation circuit 43*d* are allotted coefficients "1K8", "K8", "K7" and "1−K9"respectively.

The value K1 is determined in accordance with the shape of the thermal head 14, the material properties of the recording sheet 15, the rate of heat transfer or transmission from the heating element 14*a* to the glazed layer 18, and other factors. The value K2 is determined in accordance with the material properties of the glazed layer 18 and other factors. The value K3 is determined in accordance with the rate of heat transfer or transmission from the glazed layer 18 to the ceramic substrate 17 and other factors.

The coefficient K1 approaches to "1", as the heat transfer rate from the heating element 14*a* to the glazed layer 18 increases. The coefficient K2 approaches to "1" and the coefficient "1−K2"approaches to zero, as the heat transfer rate from the glazed layer 18 to the substrate 17 increases, and as the heat transfer rate from the glazed layer 18 to the heating element 14*a* decreases. The coefficient K3 approaches to "1" and the coefficient "1−K3" approaches to zero, as the heat transfer rate from the substrate 17 to the aluminum plate 16 increases, and as the heat transfer rate from the substrate 17 to the glazed layer 18 decreases. In the same way, the values of other coefficients K4 to K9 are determined in accordance with the respective material qualities of the substrate 17, the aluminum plate 16 and the radiation plate 21, and the rate of heat transfer between these layers.

For the thermosensitive recording, since the necessary heat energy varies depending upon the color to record in the color thermosensitive recording sheet, the values K1 to K9 also vary depending upon the color. To yellow recording, for example, K1=0.15, K2=0.91, K3=0.63, and K4=0.98. To magenta recording, K1=0.19, K2=0.91, K3=0.59, and K4=0.985. To cyan recording, K1=0.27, K2=0.87, K3=0.51, and K4=0.9832.

Now the overall operation of the data processing circuit 11 as shown in FIG. 7 will be described. When recording the line #M, the heating data of the line #M is sent from the line memory 10 to the correction circuit 40. Simultaneously, the first heat accumulation data stored in the register 45*a* of the first operation circuit 43*a*, which is derived from the heating data of the heating data of the preceding line #M−1 during the recording of the preceding line #M−1, is sequentially read and is converted into the first correction data by being multiplied by the coefficient "1−K2". Hereinafter, the first heat accumulation data obtained based on the heating data of the line #M−1 will be referred to as the first heat accumulation data of the line #M. The first correction data for one pixel is subtracted from the heating data for the corresponding pixel of the line #M at the subtracter 41. The subtraction results are each multiplied by the coefficient "K0" at the multiplier 42. The heating data thus corrected is sent to the head driver 12, which then drives the heating elements 14*a* to record the line #M in correspondence with the heating data of the line #M.

The corrected heating data of the line #M is also multiplied by the coefficient "K1" at the multiplier 48*a* of the first operation circuit 43*a*, to be converted into data representative of heat energy transmitted from the heating elements 14*a* to the glazed layer 18 during the recording of the line #M.

On the other hand, the first heat accumulation data is also multiplied by the coefficient "K2" at the multiplier 47*a*. The output of the multiplier 47*a* is multiplied by the coefficient "1−K3" at the multiplier 50*a*, to be converted into data representative of heat energy that has been accumulated in the glazed layer 18 due to the past heating and stays accumulated therein to the end of recording the line #M. The output of the multiplier 47*a* is also sent to the multiplier 48*b* of the second operation circuit 43*b*.

By multiplying the coefficient "K3" at the multiplier 48*b*, the data is converted into data representative of heat energy that is transmitted from the glazed layer 18 to the substrate 17 during the recording of the line #M. Simultaneously, the second heat accumulation data stored in the register 45*b* of the second operation circuit 43*b* is sequentially read and is converted into the second correction data by being multiplied by the coefficient "1−K4". The second correction data is sent to the adder 49*a* of the first operation circuit 43*a*. The second correction data for one pixel represents a heat energy value that has been accumulated due to the past heating and is transmitted from the substrate 17 to the glazed layer 18 under the corresponding heating element 14*a* during the recording of the line #M.

Simultaneously, the second heat accumulation data is multiplied by the coefficient "K4" at the multiplier 47*b*, to be converted into data representative of heat energy that has been accumulated in the substrate 17 due to the past heating, and is not transmitted to the glazed layer 18. The output of the multiplier 47*b* is multiplied by the coefficient "1−K5" at the multiplier 50*b*, to be converted into data representative of heat energy that has been accumulated due to the past heating and stays accumulated in the substrate 17 to the end of recording the line #M. The output of the multiplier 47*b* is also sent to the multiplier 48*c* of the third operation circuit 43*c*.

In the same way as the second operation circuit 43*b*, the third operation circuit 43*c* multiplies the data by the coefficient "K5" at the multiplier 48*c*, to obtain data representative of heat energy transmitted from the substrate 17 to the aluminum plate 16. Simultaneously, the third heat accumulation data stored in the register 45*c* of the third operation circuit 43*c* is sequentially read and is converted into the third correction data by being multiplied by the coefficient "1−K6". The third correction data is sent to the adder 49*b* of the second operation circuit 43*b*.

The third correction data for one pixel represents a heat energy value that has been accumulated due to the past heating and is transmitted from the aluminum plate 16 to an individual portion of the substrate 17 under the corresponding heating element 14*a*. Simultaneously, the third heat accumulation data is multiplied by the coefficient "K6" at the multiplier 47*c*, and then by the coefficient "1−K7" at the multiplier 50*c*, to be converted into data representative of heat energy that has been accumulated in the aluminum plate 16 due to the past heating and stays accumulated to the end of recording the line #M. The output of the multiplier 47*c* is also sent to the multiplier 48*d* of the fourth operation circuit 43*d*.

By multiplying the coefficient "K7" at the multiplier 48*d*, the data is converted into data representative of heat energy transmitted from the aluminum plate 16 to the radiation plate 21. Simultaneously, the fourth heat accumulation data stored in the register 45*d* of the fourth operation circuit 43*d* is sequentially read and is converted into the fourth correction data by being multiplied by the coefficient "1−K8". The fourth correction data is sent to the adder 49*c* of the third operation circuit 43*c*. The fourth correction data for one pixel represents a heat energy value that has been accumulated due to the past heating and is transmitted from the radiation plate 21 to the aluminum plate 16 under the corresponding heating element 14*a*. Simultaneously, the fourth heat accumulation data is multiplied by the coefficient "K8" at the multiplier 47*d*, and then by the coefficient "1−K9" at the multiplier 50*d*.

In the first operation circuit 43*a*, the output of the multiplier 48*a*, the output of the multiplier 50*a*, and the second correction data from the second operation circuit 43*b* are added at the adder 49*a*. The output of the adder 49*a* is processed by the filter 51*a* in the way as set forth above. In this way, a new series of first heat accumulation data is obtained during the recording of the line #M based on the heating data of the line #M, the previously stored first heat accumulation data of the line #M−1, and the second correction data. The new series of first heat accumulation data sequentially takes the place of the first heat accumulation data of the line #M−1 in the register 45*a*.

In the second operation circuit 43*b*, the output of the multiplier 48*b*, the output of the multiplier 50*b*, and the third correction data from the third operation circuit 43*c* are added at the adder 49*b*. The output of the adder 49*b* is processed by the filter 51*b* in the same way as described with respect to the filter 51*a*, so as to take not only an individual heat accumulation in a portion of the substrate 17 that is disposed under each individual heating element 14*a*, but also the influence of heat accumulation in adjacent portions of the substrate 17 into consideration. In this way, a new series of second heat accumulation data is obtained during the recording of the line #M, based on the first heat accumulation data of the line #M−1, the previously stored second heat accumulation data, and the third correction data.

In the same way, the content of the register 45*c* is revised by a new series of third heat accumulation data that is obtained based on the previously stored second heat accumulation data, the previously stored third heat accumulation data, and the fourth correction data. The content of the register 45*d* is revised by a new series of fourth heat accumulation data that is obtained based on the previously stored third heat accumulation data, and the previously stored fourth heat accumulation data.

When recording the next line #M+1, the first to fourth correction data is calculated based on the first to fourth heat accumulation data newly written in the register 45*a* to 45*d* during the recording of the line #M, in the same way as set forth above.

As described so far, not only thermal histories of the respective heating elements 14*a*, but also thermal histories of all the heat accumulating layers 17, 16, 15 and 21, i.e. heat accumulation in the respective layers and heat transmission between these layers, are considered in generating the first correction data. Consequently, the influence of beat accumulation on the individual heating element 14*a* is estimated with accuracy, so the heating data is corrected precisely. In addition, the heat accumulation data of each heat accumulating layer is obtained by filtering an individual heat accumulation value relating to the individual heating element 14*a* based on those individual heat accumulation values relating to the adjacent heating elements 14*a*, in each of the filters 51*a* to 51*d*. Therefore, the heating data for the individual heating element 14*a* is corrected while taking account of the influence of heat accumulations in those portions of the respective heat accumulating layers which relate to the adjacent heating elements 14*a*.

The corrected heating data of the respective heating elements 14*a* is also sent to the shift register 30 of the heating start timing correction circuit 13, and is written therein as the heat energy data $E_1$ to $E_n$ of the respective heating elements 14*a*. On the basis of the heat energy data $E_1$ to $E_n$ written in the shift register 30, the heating start timing correction circuit 13 obtains friction factor data $\mu_1$ to $\mu_n$ of the respective heating elements 14*a* with reference to the first LUT 32, and multiplies the friction factor data $\mu_1$ to $\mu_n$ with the pressure data $P_1$ to $P_n$, thereby to obtain frictional force data $f_1$ to $f_n$ for the respective heating elements 14*a*.

The frictional force data $f_1$ to $f_n$ is integrated in the integrator 35, to obtain a total frictional force F of the thermal head 14 at each line recording. The second LUT 33 produces a time shifting amount T from the total frictional force F for each line recording. The timer 36 shifts the standard timing signal by the amount T, and sends the shifted timing signal to the head driver 12. The head driver 12 drives the respective heating elements 14*a* at the timing determined by the timing signal from the timer 36 in accordance with the heating data corrected by the data processing circuit 11, recording an image line by line on the recording sheet 15. Since the corrected heating data is used as the heat energy data $E_l$ to $E_n$ for calculating or estimating surface temperatures of the respective heating elements 14*a* and thus the total frictional force F of the thermal head 14, an accurate calculation is possible without the need for any specific mechanism.

In the above embodiment, the pressure data $P_1$ to $P_n$ of the respective heating elements 14*a* is stored for use in obtaining frictional force data $f_1$ to $f_n$ of the respective heating elements 14*a*. However, it is possible to omit the pressure data register 31 and the multiplier 34, and use a constant pressure value for obtaining the time shifting amount T from the standard timing signal. In that case, frictional force data $f_1$ to $f_n$ of the respective heating elements 14*a* is obtained directly from the heat energy data $E_1$ to $E_n$, and the frictional force data $f_1$ to $f_n$ is integrated to obtain a total frictional force F of the thermal head 14. The total frictional force F is multiplied with the constant pressure value to obtain a variation in the actual transport speed. A time shifting amount T for the standard timing signal is determined by the transport amount variation.

Instead of calculating friction factors between the respective heating elements 14*a* and the recording sheet 15 based on the heat energy values estimated for each line #M to record, it is possible to obtain a difference $\Delta\mu$ between a friction factor $\mu_{M-1}$ of the preceding line #M−1 and a friction factor $\mu_M$ of the #M, i.e. $\Delta\mu=\mu_M-\mu_{M-1}$, and drives a time shifting amount T from the difference $\Delta\mu$. In that case, a data table showing a relationship between the friction factor difference $\Delta\mu$ and the time shifting amount T should be previously obtained and stored in a LUT.

It is also possible to use the first heat accumulation data written in the register 45*a* of the first operation circuit 41 instead of the corrected heating data as heat energy data for estimating the frictional force F of the thermal head 14 in order to correct or shifting the heating start timing at each line recording. Furthermore, it is possible to use a calculation formula instead of the LUTs 32 and 33 for obtaining a time shifting amount T from the estimated heat energies of the heating elements 14*a*.

The construction of the data processing circuit 11 for correcting the heating data to eliminate the influence of heat accumulation in the thermal head 14 is not limited to the above embodiment, but can be modified in the way as set forth below. Any of the following embodiments can achieve a high correction accuracy that is comparable to the above embodiment.

Figure 9:
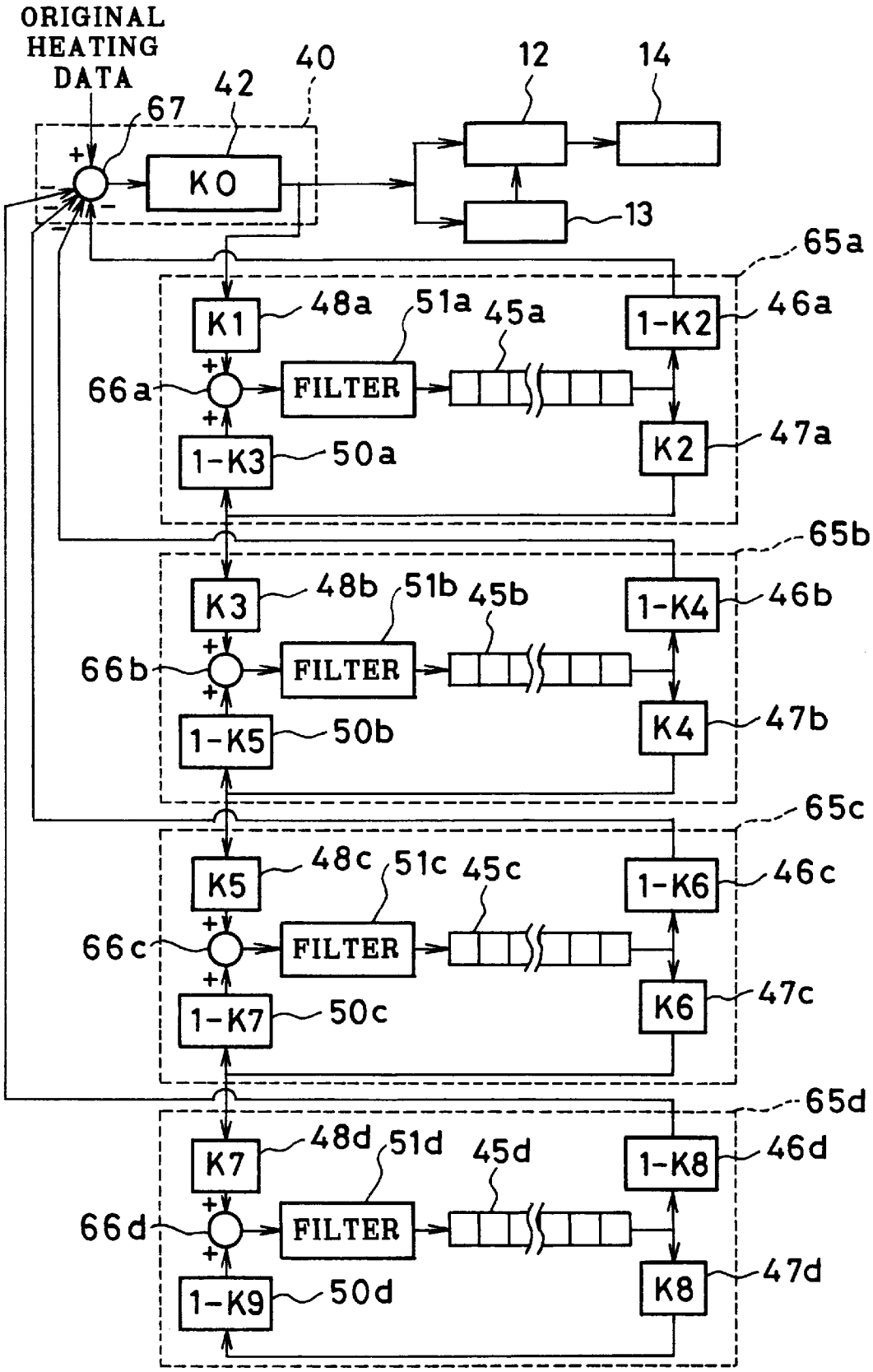
FIG. 9 is a block diagram showing a data processing circuit according to a second embodiment of the present invention.

In the embodiment shown in FIG. 9, first to fourth operation circuits 65*a* to 65*d* are provided for calculating first to fourth heat accumulation data relating to the glazed layer 18, the substrate 17, the aluminum plate 16 and the radiation plate 21 respectively, and for calculating based on the first to fourth heat accumulation data first to fourth correction data for correcting original heating data of the next line in the approximately same way as in the embodiment of FIG. 7. The first to fourth correction data calculated for each pixel is sent directly to a subtracter 67 of a correction circuit 40, to be subtracted from original heating data of a corresponding pixel, instead of being sent to subtracters 66*a* to 66*d* provided respectively in the first to fourth operation circuits 65*a* to 65*d*.

Figure 10:
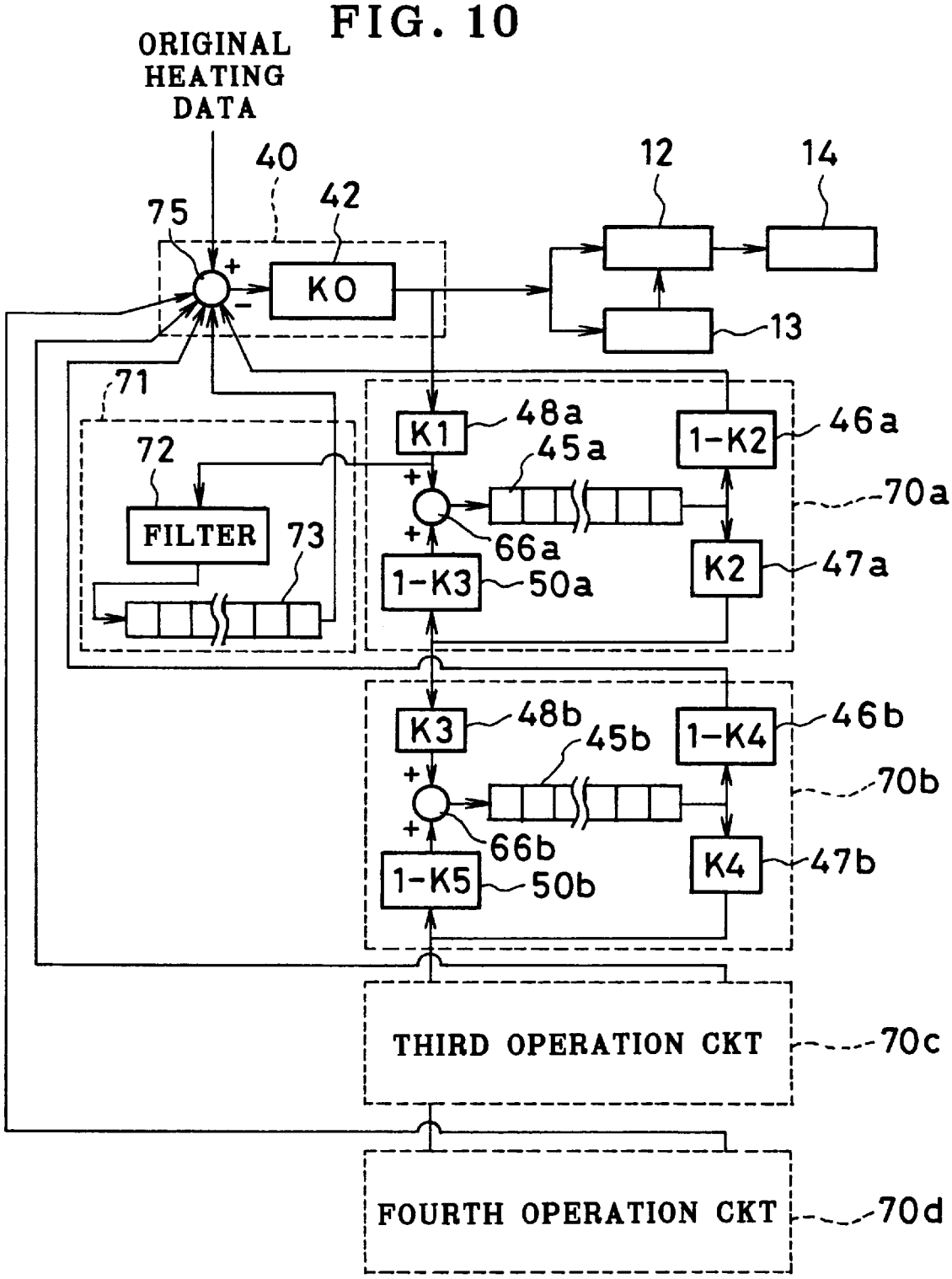
FIG. 10 is a block diagram showing a data processing circuit according to a third embodiment of the present invention.

In the embodiment shown in FIG. 10, first to fourth operation circuits 70*a* to 70*d* are provided for calculating first to fourth heat accumulation data relating to the glazed layer 18, the substrate 17, the aluminum plate 16 and the radiation plate 21 respectively. The first to fourth operation circuits 70*a* to 70*d* has no filter, but a filter circuit 71 having a filter 72 and a shift register 73 is provided in connection with the first operation circuit 70*a*. The filter 72 receives output data of a multiplier 48*a* in serial, each data piece represents a heat energy value generated by a heating of a heating element 14*a* and is transmitted from a heating element 14*a* to the glazed layer 18. The filter 72 derives sub-correction data for correcting the heating data of each pixel with regard to the influence of heat accumulation in those portions of the glazed layer 18 which are disposed under the adjacent heating elements 14*a*. The sub-correction data for one line derived from the output data of the multiplier 48*a* for one line is written in the register 73. The sub-correction data for one line is sent in serial to a subtracter 75 of a correction circuit 40 during the recording of the next line, concurrently with first to fourth correction data from the first to fourth operation circuit 70*a* to 70*d*, calculated based on the first to fourth heat accumulation data obtained during the recording of the preceding line. The first and fourth operation circuit 70*c* and 70*d* have the same construction as the second operation circuit 70*b*, though multiplication coefficients are different from each other.

In any of the above embodiments, it is possible to input original heating data to the first operation circuit 43*a*, 65*a*, or 70*a*, instead of corrected heating data, as is shown for example in FIG. 11. It is also possible to omit the multiplier 42 from the correction circuit 40 in any of the above embodiments. Moreover, it is possible to omit the filters 51*a* to 51*d* from the operation circuits 43*a* to 43*d*. It is possible to provide the filter circuit 71 in connection to the operation circuit 43*a* after omitting the filters 51*a* to 51*d*.

Although the present invention has been described with respect to the thermosensitive recording type thermal printing, the present invention is applicable to the ink transfer type thermal printing in the same way. Besides the line printer as above, the present invention is applicable to a serial printer where the thermal head moves in a first direction while the recording sheet moves in a second direction perpendicular to the first direction. Although the above embodiments have four operation circuits in correspondence with four beat accumulating layers of the thermal head, the number of operation circuits is variable depending upon the number of heat accumulating layers. Furthermore, the operation circuits can be a CPU.

Thus, the present invention should not be limited to the above described embodiments but, on the contrary, various modification may be possible to those skilled in the art without departing from the scope of claims attached hereto.

What is claimed is:

1. A thermal printing method for printing an image line by line on a recording material by driving an array of heating elements of a thermal head while transporting the recording material relative to the thermal head, the method comprising the steps of:

A. estimating surface temperatures of the respective heating elements on the basis of heating data applied to the thermal head for recording a subject line to print;

B. obtaining data of friction between the thermal head and the recording sheet on recording said subject line on the basis of said estimated surface temperatures as a factor to cause a fluctuation in transport speed of the recording material through the thermal head;

D. determining a time shifting amount with respect to a standard time to start recording said subject line depending upon said friction data; and E. starting driving the heating elements to record said subject line at a time shifted by the time shifting amount from the standard time, thereby to eliminate influence of fluctuations in transport speed of the recording sheet on the printed image.

2. The thermal printing method as claimed in claim 1, further comprising the steps of:

calculating a heat accumulation amount for each of the heating elements of the thermal head on the basis of heating data applied to the thermal head for recording preceding lines;

correcting original heating data for said subject line in accordance with said heat accumulation amounts of the respective heating elements; and driving the heating elements in accordance with corrected heating data, wherein surface temperatures of the heating elements are estimated on the basis of said corrected heating data.

3. The thermal printing method as claimed in claim 1, wherein step B comprising the steps of:

deriving friction factors of the respective heating elements from said heating data for said subject line; and calculating a total frictional force that will be generated between the thermal head and the recording sheet during recording said subject line, on the basis of said friction factors and previously obtained pressure data indicating pressure distribution of the thermal head onto the recording sheet.

4. The thermal printing method as claimed in claim 1, wherein step B comprises the steps of:

deriving friction factors of the respective heating elements from said heating data for said subject line;

obtaining differences between the friction factors derived for said subject line and friction factors derived for a preceding line; and determining said time shifting amount depending upon said differences in friction factors.

5. The thermal printing method as claimed in claim 2, wherein the thermal head has first to Nth heat accumulating layers disposed under the heating elements in this order from the side of heating elements, one pixel of each line being assigned to one heating element of the array in regular sequence, the method comprising the steps of:

obtaining first to Nth correction data for said subject line by multiplying first to Nth heat accumulation data by first to Nth coefficients respectively, said first to Nth heat accumulation data being previously stored and representative of respective thermal histories of said first to Nth heat accumulating layers relating to each heating element of the array;

correcting original heating data of said subject line, with said first correction data in pixel-to-pixel correspondence, to obtain corrected heating data of said subject line;

preparing a new series of first heat accumulation data on the basis of said original or said corrected heating data of said subject line, said previously stored first heat accumulation data, and said second correction data;

storing said new series of first heat accumulation data in place of said previously stored first heat accumulation data, during the recording of said subject line;

preparing a new series of Jth heat accumulation data, J being 2 to N−1, on the basis of said previously stored (J−1)th heat accumulation data, said previously stored Jth heat accumulation data, and said (J+1)th correction data;

storing said new series of Jth heat accumulation data in place of said previously stored Jth heat accumulation data, during the recording of said subject line;

preparing a new series of Nth heat accumulation data on the basis of said previously stored (N−1)th heat accumulation data, and said previously stored Nth heat accumulation data;

storing said new series of Nth heat accumulation data in place of said previously stored Nth heat accumulation data, during the recording of said subject line;

obtaining new series of first to Nth correction data for a next line to print, from said newly stored first to Nth heat accumulation data respectively; and repeating the above steps for each line to print.

6. The thermal printing method as claimed in claim 2, wherein the thermal head has first to Nth heat accumulating layers disposed under the heating elements in this order from the side of heating elements, one pixel of each line being assigned to one heating element of the array in regular sequence, the method comprising the steps of:

obtaining first to Nth correction data for said subject line by multiplying first to Nth heat accumulation data by first to Nth coefficients respectively, said first to Nth heat accumulation data being previously stored and representative of respective thermal histories of said first to Nth heat accumulating layers relating to each heating element of the array;

correcting original heating data of said subject line, with said first to Nth correction data in pixel-to-pixel correspondence, to obtain corrected heating data of said subject line;

preparing a new series of first heat accumulation data on the basis of said original or said corrected heating data of said subject line, and said previously stored first heat accumulation data;

storing said new series of first heat accumulation data in place of said previously stored first heat accumulation data, during the recording of said subject line;

preparing a new series of Jth heat accumulation data, J being 2 to N, on the basis of said previously stored (J−1)th heat accumulation data, and said previously stored Jth heat accumulation data;

storing said new series of Jth heat accumulation data in place of said previously stored Jth heat accumulation data, during the recording of said subject line;

obtaining new series of first to Nth correction data from said newly stored first to Nth heat accumulation data, for use in correcting heating data of a next line to print; and repeating the above steps for each line to print.

7. The thermal printing method as claimed in claim 5 or 6, wherein further comprises the steps of:

filtering each heat accumulation value for one pixel with use of those heat accumulation values for adjacent pixels, said filtering step comprising the steps of:

multiplying said each heat accumulation value by a predetermined coefficient;

multiplying said heat accumulation values for the adjacent pixels by individual coefficients determined by relative positions of the adjacent pixels to said one pixel;

adding up multiplication results, to use a consequent sum as a filtered heat accumulation value for said one pixel; and serving said filtered heat accumulation values for one line as said new series of first, Jth or Nth heat accumulation data.

8. A thermal printer having a thermal head with an array of heating elements for printing an image line by line on a recording material while transporting the recording material relative to the thermal head, the thermal printer comprising:

a first means for estimating surface temperatures of the respective heating elements on the basis of heating data applied to the thermal head for recording a subject line to print and heat accumulation data calculated on the basis of heating data applied to the thermal head for recording preceding lines;

a second means for obtaining data of friction that will be generated between the thermal head and the recording sheet during recording said subject line on the basis of said estimated surface temperatures;

a third means for determining a time shifting amount with respect to a standard time to start recording said subject line on the basis of said friction data;

a fourth means for starting driving the heating elements to record said subject line at a time shifted by the time shifting amount from the standard time.

9. The thermal printer as claimed in claim 8, wherein said second means derives a total frictional force of the thermal head against the recording sheet from said estimated surface temperatures and previously obtained pressure data indicating pressure distribution of the thermal head to the recording sheet, whereas said third means determines the time shifting amount depending upon the total frictional force of the thermal head.

* * * * *